United States Patent [19]

Gounder

[11] Patent Number: 4,575,726

[45] Date of Patent: Mar. 11, 1986

[54] ANTENNA CONSTRUCTION INCLUDING TWO SUPERIMPOSED POLARIZED PARABOLIC REFLECTORS

[75] Inventor: Raj N. Gounder, Robbinsville, N.J.

[73] Assignee: RCA Corporation, Princeton, N.J.

[21] Appl. No.: 408,503

[22] Filed: Aug. 16, 1982

[51] Int. Cl.[4] ..... H01Q 15/22; H01Q 15/16

[52] U.S. Cl. ..... 343/756; 343/840

[58] Field of Search ..... 343/756, 840, 909, 912

[56] References Cited

U.S. PATENT DOCUMENTS

| | | | |
|---|---|---|---|
| 2,682,491 | 6/1954 | Hahn | 154/110 |
| 2,742,387 | 4/1956 | Giuliani | 154/110 |
| 3,096,519 | 7/1963 | Martin | 343/756 |
| 3,137,000 | 6/1964 | Fuller | 343/756 |
| 3,483,614 | 12/1969 | Kazimi | 29/600 |
| 3,898,667 | 8/1975 | Raab | 343/756 |

FOREIGN PATENT DOCUMENTS

| | | | |
|---|---|---|---|
| 1213871 | 4/1960 | France | 343/779 |

OTHER PUBLICATIONS

"The SBS Communication Satellite–An Integrated Design," by H. A. Rosen, designated CH1352–4/78/00-00–0343, published by the IEEE, pp. 343–347.

"Advanced Composite Structures for Satellite Systems," by R. N. Gounder, *RCA Engineer*, Jan./Feb. 1981, pp. 12–22.

"Optimized Design and Fabrication Processes for Advanced Composite Spacecraft Structures," by V. F. Mazzio et al., *17th Aerospace Sciences Meeting*, New Orleans, LA, Jan. 15–17, 1979, pp. 1–8.

"KEVLAR Aramid The Fiber That Lets You Re--Think Strength and Weight," published by DuPont Company.

*Primary Examiner*—Eli Lieberman

*Attorney, Agent, or Firm*—Joseph S. Tripoli; George E. Haas; William Squire

[57] ABSTRACT

A compact frequency reuse communications antenna includes two superimposed structures, each including Kevlar honeycomb, fabric face skins on the honeycomb, and a reflector over one of the face skins, the two structures being spaced from one another by Kevlar ribs formed of honeycomb material. The directions in which the ribbons of the honeycomb cores of the superimposed structures extend, and the directions of the elements making up the reflector of the fabric warps are chosen to minimize thermal distortions and RF losses while providing high natural frequency and low weight.

12 Claims, 13 Drawing Figures

ANTENNA CONSTRUCTION INCLUDING TWO SUPERIMPOSED POLARIZED PARABOLIC REFLECTORS

The present invention relates to an antenna construction such as may be used for a compact frequency reuse antenna.

An antenna system which achieves frequency reuse by sources and reflectors which are responsive to orthogonally polarized waves is disclosed in U.S. Pat. Nos. 3,898,667; 3,096,519, and in an article entitled "The SBS Communication Satellite—An Integrated Design," by H. A. Rosen, designated CH1352-4/78/0000-0343, published by the IEEE, pp. 343–347 In U.S. Pat. No. 3,898,667 the reflectors are overlaid with their respective focus points non-coincident. Each reflector has a reflecting surface comprising parallel, reflecting, conductive elements with the reflecting elements of one reflector oriented orthogonally to the reflecting elements in the other. Each reflector has an associated feed copolarized with respect to the elements of the particular reflector. Each reflector is a portion of a paraboloid of revolution. A portion of a first reflector whose elements have one orientation, e.g., horizontal, overlaps a portion of a second reflector whose elements have a second orientation, e.g., vertical. A portion of a third reflector whose elements are oriented the same as the second reflector elements overlaps a portion of a fourth reflector whose elements are oriented the same as the first reflector elements. The reflectors are mounted to a satellite structure by support posts. The material for the support posts is disclosed as a graphite fiber epoxy composite (GFEC) which is opaque to electromagnetic waves.

In U.S. Pat. No. 3,096,519 there is disclosed a composite microwave energy reflector containing a surface common to the otherwise independent reflectors which is suitable for application in a V-beam height finding radar system. In this structure two identically shaped reflectors are first superimposed so that the respective elemental surfaces are everywhere in intimate contact. Then, one of the reflectors is rotated about the axis of revolution of the figure of revolution to which a portion of each reflector conforms. This results in a composite reflector. Further, only a portion of each component antenna of the composite reflector is conformal to a paraboloid. As the angle of rotation increases through which the reflectors are mutually displaced, the extent of the remaining common area between the antennas decreases, increasing the overall area of the antenna.

In the SBS Communication Satellite article a communications antenna is described which consists of two essentially independent offset grid reflectors that are superimposed in the same aperture. One is horizontally polarized and the other vertically polarized. The reflector diameters and focal lengths are identical for each polarization. The bottoms of the two reflectors are offset, allowing a corresponding offset of the focal planes. Two separate feed arrays can be used for transmit and receive which do not physically interfere with each other. The front horizontal grid reflector is essentially RF transparent to vertically polarized signals reflected from the rear reflector. The super-position of reflectors in a single aperture allows two reflectors to share structural support and have a large diameter. However, the construction of overlapping antennas for orthogonally polarized beams is not without problems.

It is difficult to provide good electrical response of the two antennas while maintaining relatively high mechanically resonant frequencies for the structure so that it can withstand launch and operating vibrations and also to have thermal response characteristics in which distortions due to variations in expansion in the different materials are minimum.

In an antenna construction embodying the present invention, first and second electromagnetic wave reflectors are spaced one over the other, each reflector comprising an array formed of a plurality of parallel, spaced elongated electromagnetic wave reflecting elements, the elements of one array extending in the direction normal to the reflector elements of the other arrays, and an element support structure for supporting elements of that reflector, each element support structure comprising a member transparent to electromagnetic waves and having a shape conforming to that of its array of reflecting elements. Radiation transparent rib means are secured to and between the support structures to form a sandwich construction with the support structures whereby when a wave is applied through the first reflector to the second reflector the linearly polarized component thereof reflected from the array of reflecting elements of the second reflector passes through the space occupied by the rib means, the element support structure of the first reflector, and the array of reflecting elements of the first reflector.

Communications antenna reflectors employed particularly for satellite communications have reflecting surfaces described by the following equation:

$$U^2+V^2=4fW$$

where U and V are coordinates of any point on the reflecting surface, and f is the focal length of the reflector. This equation describes the surface of revolution (paraboloid) about axis W and centered at $U=V=W=0$. The centroid is commonly known as a vertex. A number of methods of constructions are known for providing such reflecting surfaces. In one method of construction orthogonally woven metallic (RF) conductive wire or solid metallic surfaces form the RF reflective surface. In another construction, parabolically shaped polarizing grid wires are employed as a reflecting surface. These grid wires when projected onto the U-V plane are all parallel either to the U (horizontally polarized) or the V (vertically polarized) axis of the paraboloid. Such singly oriented surfaces are reflective to RF beams of the same polarization and are transparent to RF beams that are polarized normal to the grid wire polarization. By virtue of this construction, two reflecting surfaces responsive to orthogonal polarized waves can be stacked one above the other thus resulting in an optimum packaging of the antenna reflecting surfaces within a limited volume of the launch envelope.

However, these parabolically shaped, singly oriented grid wires need to be supported by secondary structures such that the reflecting surfaces are maintained in their proper shapes and positions throughout their mission environment. The mission environment includes all ground, launch, transfer orbit, and operational space orbit environments. These secondary structures in addition to maintaining the proper shapes and positions of the polarizing grid wires, should exhibit minimum electrical interaction (be transparent) to the RF beams. This is especially true for the reflector that sits in the way of the RF beam of another reflector. Thus, in a stacked configuration, the structure support for the upper horizontal reflector should be fully transparent to the vertically polarized RF beam to be reflected by the lower vertical reflector. The structure described below provides a construction to support the two reflectors to minimize electrical interaction and to maximize the requirement to maintain the structures in their proper shapes and positions throughout their mission environment regardless the thermal inputs to the structures.

The structure to be described comprises two fully overlapping advanced fiber reinforced composite honeycomb core sandwich shells which are connected by a common stiffener rib structure forming a super-sandwich construction. By the term "super-sandwich" is meant a construction comprising several sandwich layers which are combined in a further sandwich construction, i.e., multiple sandwich layers combined to form a composite sandwich whose elements are sandwich constructions.

Figure 1:
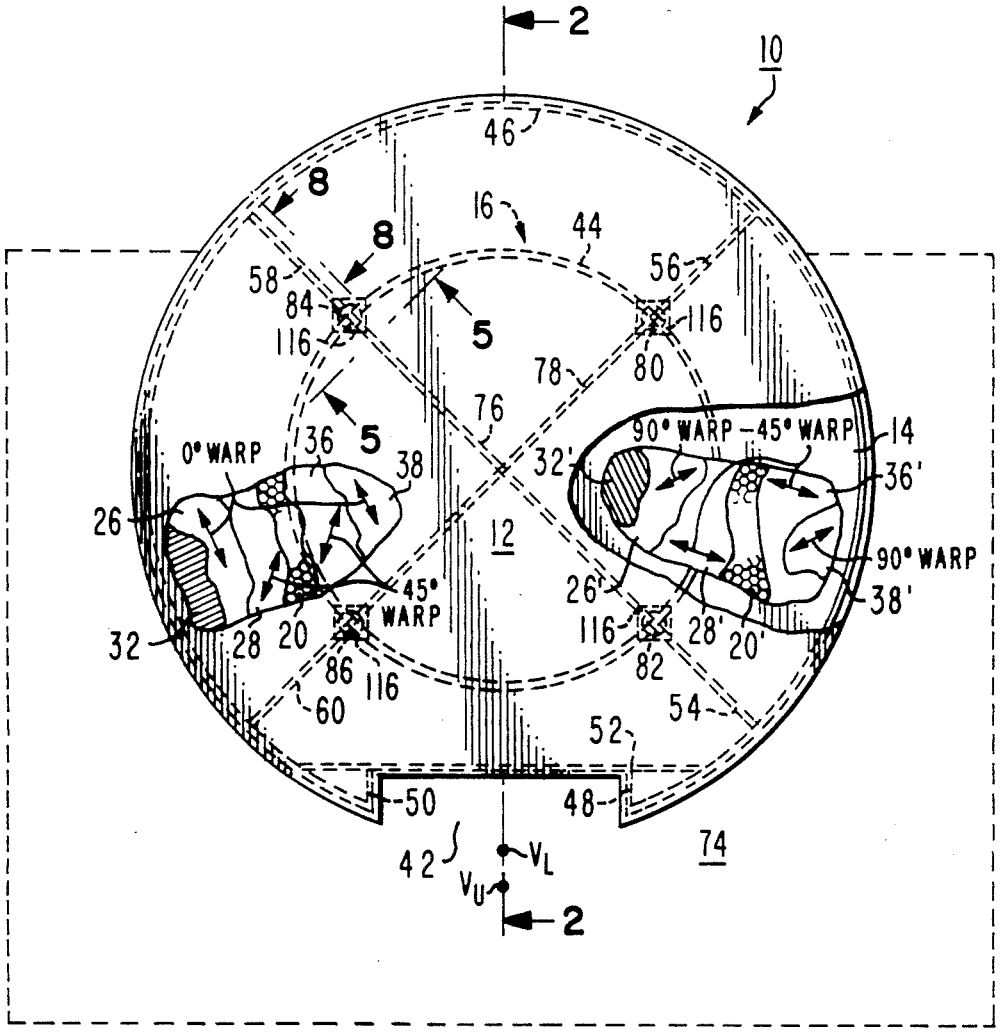
FIG. 1 is a front elevation view of a pair of superimposed orthogonally oriented antenna reflectors according to one embodiment of the present invention.
Figure 2:
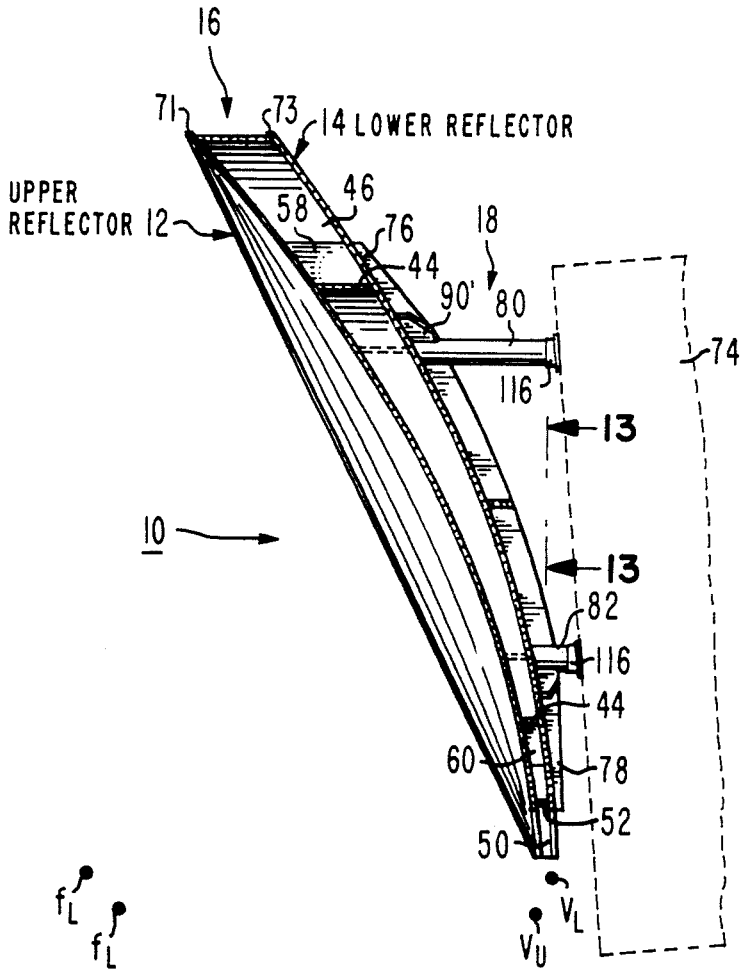
FIG. 2 is a sectional view of the embodiment of FIG. 1 taken along lines 2—2.
Figure 3:
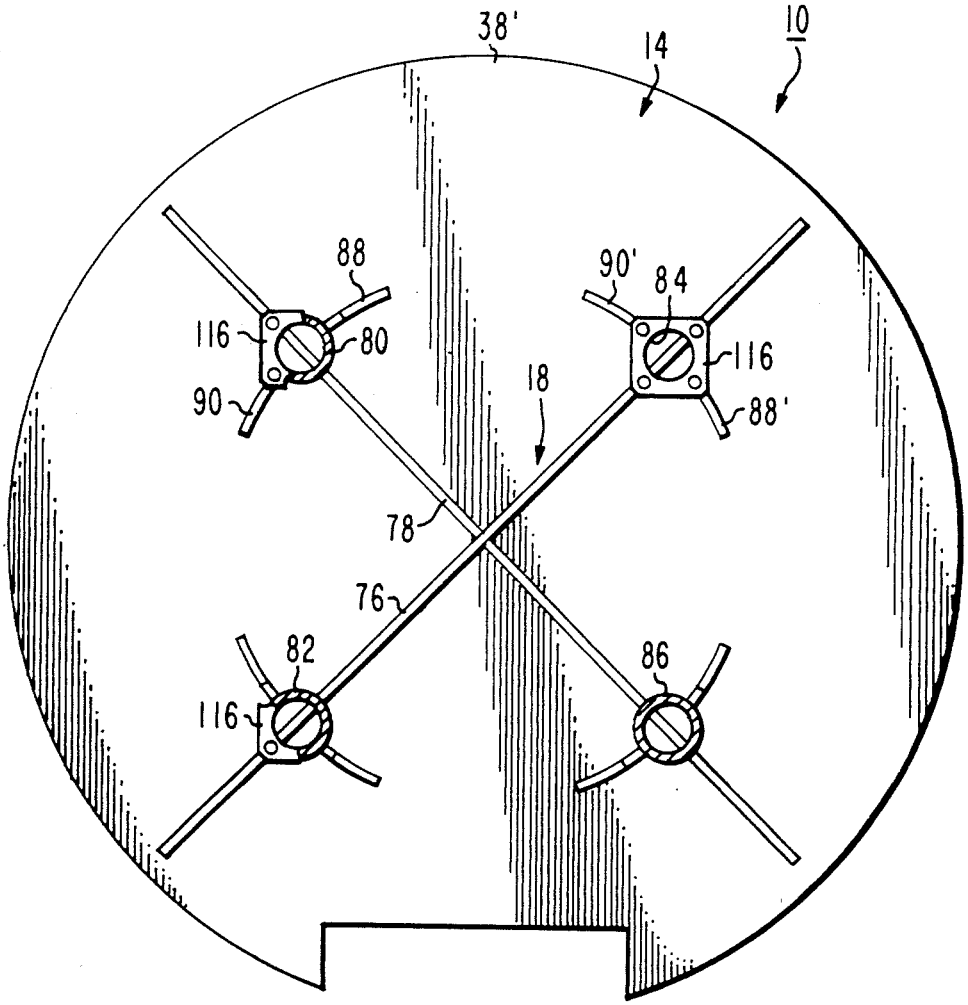
FIG. 3 is a rear elevational view of the embodiment of FIG. 1.

In FIGS. 1, 2, and 3 the antenna comprises an upper reflector 12, a lower reflector 14, a rib structure 16 for connecting the upper reflector 12 to the lower reflector 14, and an antenna support structure 18 secured to the rear side of lower reflector 14. Not shown are the horn assemblies for radiating electromagnetic waves to or receiving electromagnetic waves reflected from the antenna surfaces.

Figure 11:
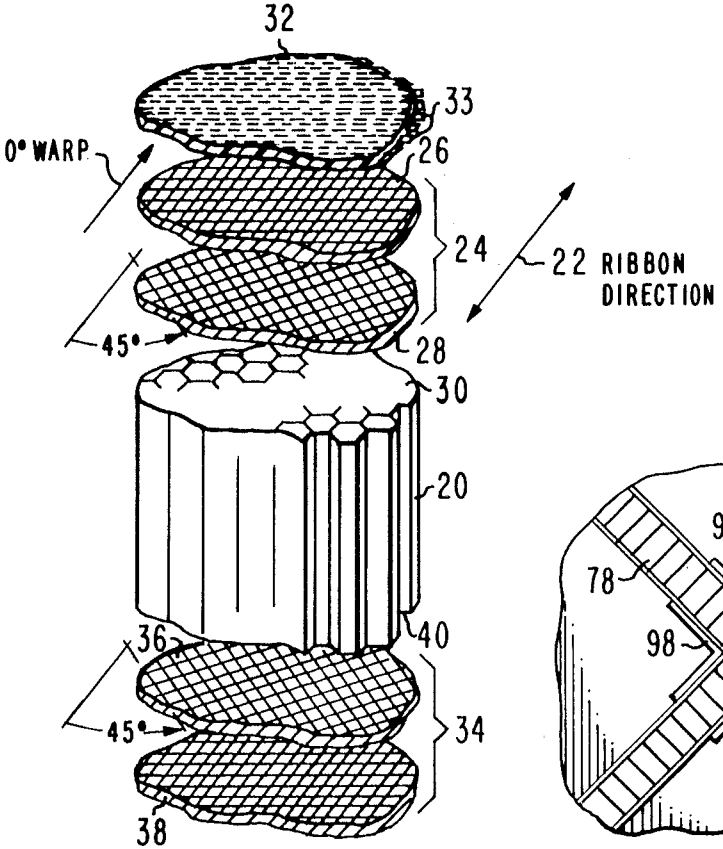
FIG. 11 is an exploded schematic view showing the various elements forming one reflector.

Reflectors 12 and 14 are constructed of similar materials as best seen in FIG. 11. The reflector 12 is constructed of a honeycomb core 20 formed of a Kevlar fabric epoxy-reinforced material, preferably a DuPont Kevlar fabric style 120. The core may have a thickness of, by way of example, ⅛ to ½ inch. Kevlar is an E. I. DuPont registered trademark for a polyparabenzamide material available as fibers or as a woven fabric. The core 20 has a ribbon direction 22. By ribbon direction is meant the general direction in which the undulating ribbons, that is, the fabric layers, which form the honeycomb core extend. The core comprises side-by-side ribbons of fabric, of undulating shape, which are bonded to one another to form the hexagonal cells of a honeycomb, each cell having a length dimension orthogonal to the ribbon direction 22. The core 20 is available commerically. Core 20 is formed into a paraboloid having the shape as shown in FIGS. 1, 2, and 3.

A first face sheet 24 over core face 30 comprises two plies or layers 26, 28 of Kevlar fabric reinforced with epoxy material. The face sheet over face 30 may comprise, however, fewer or more than two plies. The layer 28 is bonded to face 30 of the core 20 with its warp (the term "warp" refers to the direction in which the primary fibers run, the secondary fibers being orthogonal to these fibers and are known as "fill") at an angle to the ribbon direction 22. By way of example, this angle may be 45°. The outer layer 26 is at a 0° warp, the ribbon direction 22 being referenced as the 0° direction. Secured over the layer 26 is a grid layer 32.

The grid layer 32 comprises an array of parallel, spaced, electrically conductive elements 33, such as copper strips, which are secured in an RF transparent medium such as a polyimide material (one such material is known as Kapton, a trademark of the DuPont Corporation). Elements 33 of the layer 32 extend normal to the ribbon direction 22.

The lower face sheet 34 also comprises two plies or layers 36, 38 of Kevlar fabric reinforced with epoxy material. Layer 36 is bonded directly to the lower face 40 of core 20. The warp of layer 36 is parallel to the warp of layer 28, that is, by way of example, at 45° to the ribbon direction 22. The warp of layer 38 is parallel to the warp of layer 26 and is in the 0° direction. The lower face sheet 34 may comprise fewer or a greater number of plies than the two shown. By way of example, each ply may be about 0.005 inch in thickness.

The orientation of the layers 26 and 28 with respect to the ribbon direction 22 and with respect to the lay of the warp of layers 36 and 38 is such as to form a planar quasi-isotropic composite structure. The upper face sheet 24 is similar in construction to the lower face sheet 34 with the exception of the additional reflecting grid layer 32 comprising the reflecting elements 33. The parallel elements 33 in the layer 32 form a reflector for radiating (or receiving) a polarized wave in a known way.

The lower reflector 14 is constructed of Kevlar fabric similarly as the upper reflector. However, the grid elements 33 of the upper reflector are secured for horizontal polarization of all reflected electromagnetic waves. The grid elements of the lower reflector are oriented 90° to the direction of orientation of the grid elements 33 of the upper reflector so that radiation it responds to (for example) is orthogonally polarized with respect to the radiation to which the upper reflector is responsive.

Referring to FIG. 1, the warp of layer 26 is designated at 0° warp as a reference. The reflecting elements 33 are oriented perpendicular relative to the 0° warp direction. The grid elements 33' of layer 32' of the lower reflector 14 are oriented 90° to the orientation of the elements 33, layer 32. Layer 26' of the lower reflector corresponding to layer 26 of the upper reflector has its warp 90° from the warp of layer 26. Similarly, the warp of the remaining layers 28', 36', and 38' corresponding to layers 28, 36, and 38 of the upper reflector 12 have their warps at 90° to the corresponding layers of the upper reflector. Thus, it is seen that the upper reflector 12 and the lower reflector 14 comprise similar materials, each forming a similar sandwich construction.

In FIG. 1 the reflectors 12, 14 in a front view, by way of example, are generally circular except for a rectangular cut-out at 42. The cut-out 42 receives the feed horn structure (not shown). The lower reflector 14 and upper reflector 12 are superimposed one over the other so as to appear as a single reflector as viewed in FIG. 1.

The two reflectors 12 and 14 are joined in a super sandwich construction by the rib structure 16, FIG. 2. The rib structure 16 is bonded directly to the outer concave front reflecting surface of lower reflector 14 and the outer rear convex surface of upper reflector 12.

Figure 4:
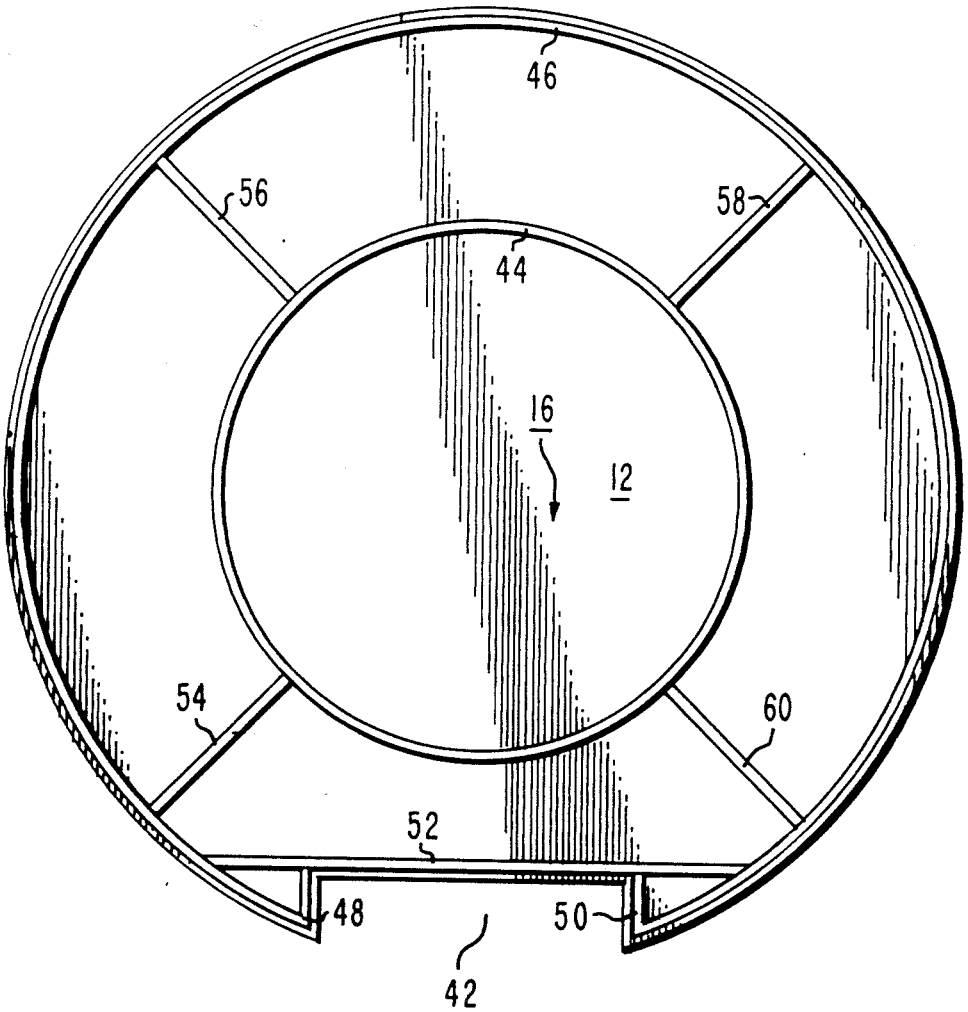
FIG. 4 is a sectional view of the antenna structure of FIG. 1 taken between the two reflectors and looking toward the upper front reflector.

Referring to FIG. 4, rib structure 16 comprises two concentric ribs 44 and 46. Rib 46 is at the outer peripheral edge of the two reflectors 12 and 14 as shown in FIG. 2. The central portion of the antenna is clear of rib elements, as shown. Parallel ribs 48 and 50 are adjacent to the corresponding edges of the cut-out 42. A transverse rib 52 abuts ribs 48 and 50 at one end and the inner surface of rib 46. Rib 52 abuts the long edge of the cut-out 42.

Stiffening ribs 54, 56, 58, and 60 are joined to and extend radially between the two ribs 44, 46 in spoke-like fashion. All of the ribs 44, 46, 48, 50, 52, 54, 56, 58, and 60 are constructed similarly. Generally, the ribs are all of sandwich construction similar to the construction of the reflectors 12 and 14 (less the reflecting grid elements) and comprises multi-ply Kevlar fabric epoxy-reinforced face sheets and single-ply Kevlar fabric epoxy-reinforced honeycomb core. The honeycomb core in the ribs may be in the range of $\frac{1}{8}$ to $\frac{1}{2}$ inch thick, by way of example.

Figure 8:
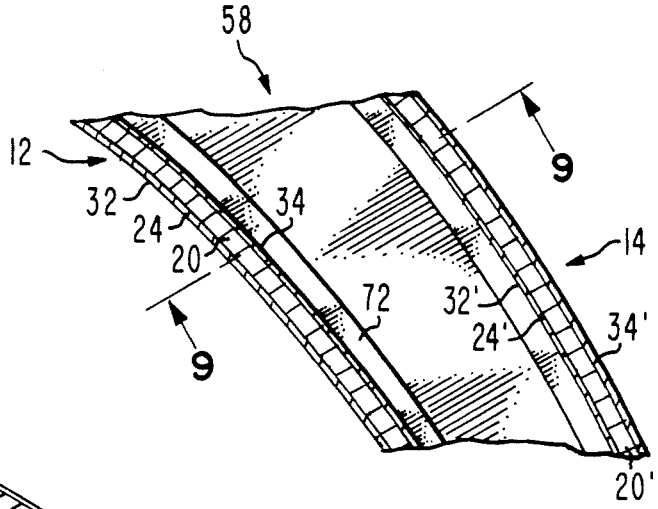
FIG. 8 is a sectional view of a portion of the embodiment of FIG. 1 taken along lines 8—8.
Figure 9:
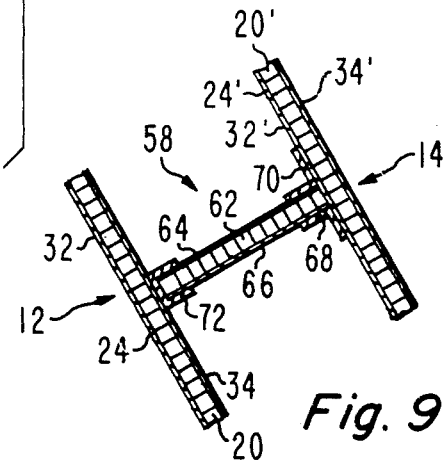
FIG. 9 is a sectional view of the structure of FIG. 8 taken along lines 9—9.

Referring to FIGS. 8 and 9, rib 58 is bonded between and to upper reflector 12 and lower reflector 14. Rib 58 includes a honeycomb core 62, and two two-ply face sheets 64 and 66. The core 62 is formed of Kevlar single-ply woven epoxy-reinforced fabric. The 0° ribbon direction is generally in the direction parallel to the length dimension of the ribs. The 0° warp direction is parallel to the core ribbon direction.

The ribs are joined to the reflectors 12 and 14 in the manner shown in FIGS. 8 and 9, using rib 58 as an example. This rib is joined to the lower reflector 14 with Kevlar fabric reinforcement clips 68 and 70 which may comprise two-ply Kevlar fabric epoxy-reinforced sheets formed in a right angle configuration. One leg of the reinforcement clip 68 is bonded to the rib 58 and the other leg is bonded to the upper concave surface of the lower reflector 14. Reinforcement clip 70 is similarly bonded to the opposite side of rib 58 and also to the concave surface of reflector 12. The two clips 68 and 70 form a channel therebetween within which fits the rib 58.

A third clip 72, this one U-shaped, fits over the upper edge of rib 58. During assembly, the upper reflector 12 is pressed against the still tacky U-shaped clips 72 and the entire structure cured in place under pressure in a known way. All of the joints between the ribs and the reflectors include clips such as clips 68, 70, and 72. The outer peripheral edges 71, 73 of the respective reflectors 12 and 14, FIG. 2, may be covered with a single ply of Kevlar epoxy-reinforced fabric closures (not shown) which are similar in section to clip 72, FIG. 9.

In FIG. 2 the vertex of the lower reflector 14 is shown at $V_L$ and the vertex of the upper reflector 12 at The vertexes of each reflector is slightly below that reflector and is centered as shown in FIGS. 1 and 2. The corresponding focal points for the lower and upper reflectors are shown at $f_L$ and $f_U$, respectively. The focal distance for the upper reflector is shown to be shorter than that for the lower reflector. These relative positions are given by way of example. It is to be understood that the corresponding electronics and feed horn assemblies are positioned at the focal points for completing the antenna system.

Figure 12:
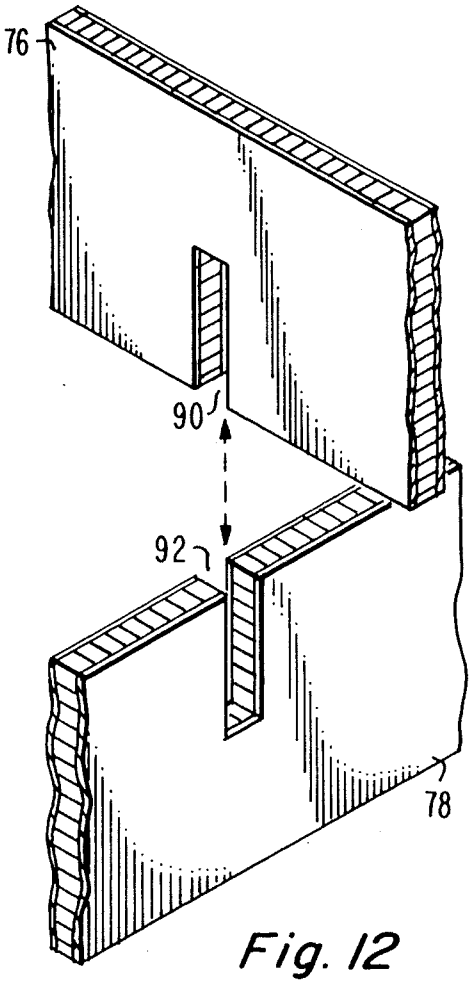
FIG. 12 is an exploded isometric view showing the construction of the elements of FIG. 12.
Figure 13:
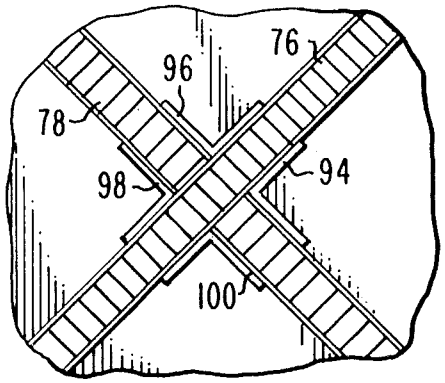
FIG. 13 is a sectional view of a portion of the embodiment of FIG. 2 taken along lines 13—13.

The support structure 18 secures the sandwich structure comprising the lower reflector 14 and upper reflector 12 and the rib structure 16 to a support such as spacecraft 74, FIG. 2. Referring to FIG. 3 the support structure 18 comprises two cross ribs 76 and 78. The ribs 76 and 78 are constructed similarly as rib 58, FIG. 9. Structure 18 also includes four circular tubular legs 80, 82, 84, and 86. A pair of curved gussets 88, 90 secure the leg 80 to the reflector 14 and similar gussets secure the remaining legs to the reflector 14. The gussets 88 and 90 are generally at right angles to the rib 78. The gussets 88 and 90 also overlie the inner annular rib 44. As shown in FIG. 12, the ribs 76 and 78 each include respective slots 90 and 92 for interlocking the rib 76 to rib 78. After being interlocked, the ribs 76 and 78 are reinforced with multi-ply Kevlar epoxy-reinforced fabric doublers 94, 96, 98, and 100, FIG. 13, which generally are L-shaped members bonded to each of the ribs at their intersections.

Figure 10:
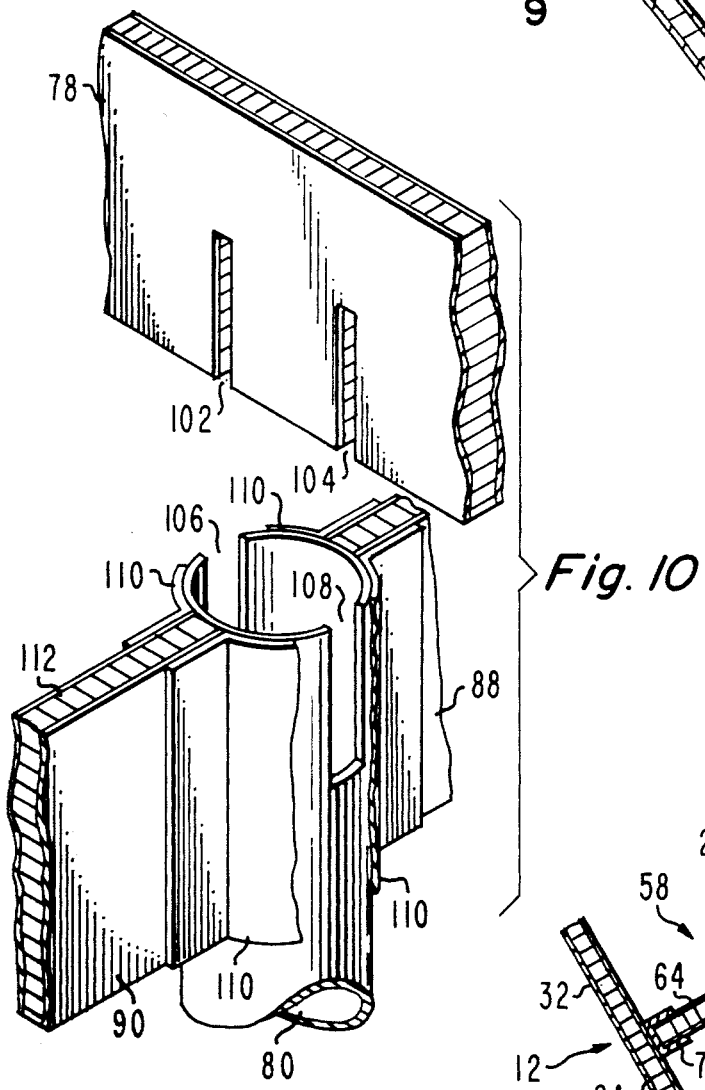
FIG. 10 is an exploded isometric view of a portion of the structure of FIGS. 1, 2, and 3.

In FIG. 10 a typical construction of the ribs 76, 78 with the gussets and corresponding legs is shown. Rib 78 is formed with two slots 102 and 104. The leg 80 is also formed with two slots 106 and 108 which respectively receive slots 102 and 104 to interlock the rib 78 with the leg 80. Gusset 90 is secured to one side of the leg 80 and gusset 88 to the opposite side of leg 80. The gussets 90 and 88 and rib 78 are further secured to the leg 80 by reinforcement doublers such as doubler 110 which may be two-ply Kevlar epoxy-reinforced fabric layers which are secured to the gusset, leg, and rib 78 at all of the intersections with rib 78. A similar doubler 110 is secured at all of the intersections of the leg, its corresponding gusset, and corresponding rib 78. In similar fashion, all of the legs 82, 84, and 86 are secured to their corresponding gussets and rib 76 or 78 as the case may be. The edge of the gusset, rib, and leg structure at 112, FIG. 10, is bonded to the convex outer surface of the lower reflector 14. Clips such as clips 68 and 72 of FIGS. 8 and 9 are employed to further secure the gussets and ribs 76 and 78 to the convex reflector 14 surface.

All of the legs 80, 82, 84, and 86 are constructed in similar fashion. The legs, by way of example, may be graphite epoxy-reinforced fabric. Metal fittings such as aluminum or titanium are bonded to the ends of the legs to mechanically secure the legs to the satellite 74, FIG. 1. A typical fitting 116, FIG. 3, comprises a square element with a circular aperture and a circular groove. The groove receives a respective end of the tubular leg 80, 82, and so forth. The legs are bonded to the fitting 116. Fitting 116 is then bolted to the satellite structure 74, FIG. 2.

Figure 6:
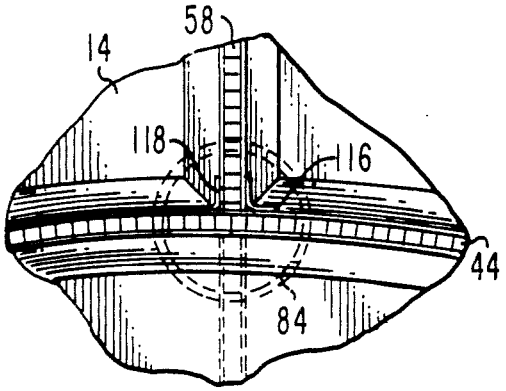
FIG. 6 is a sectional view of a portion of the embodiment of FIG. 5 taken along lines 6—6.
Figure 5:
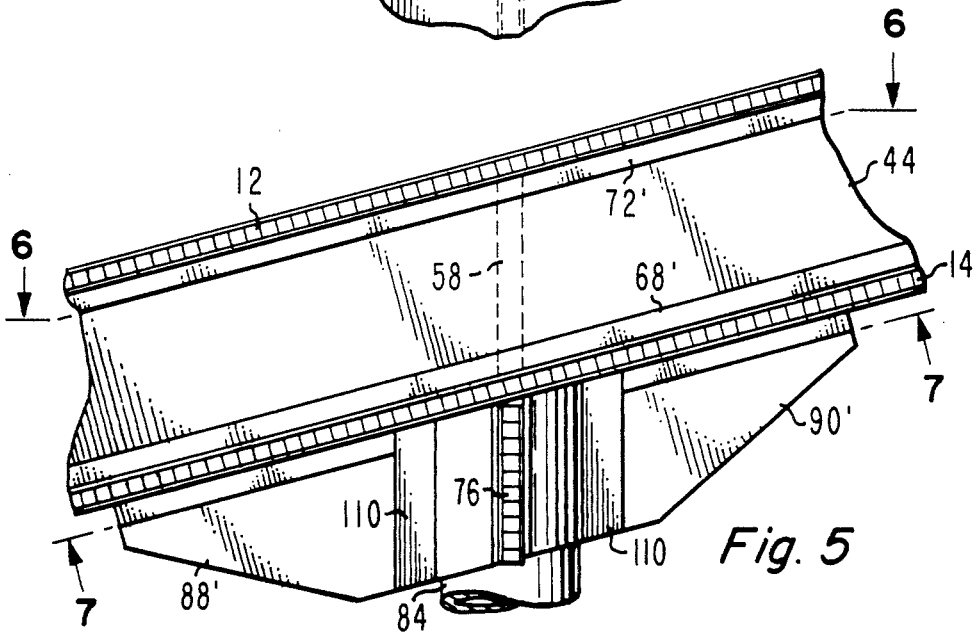
FIG. 5 is a sectional view through a portion of the embodiment of FIG. 1 taken along lines 5—5.
Figure 7:
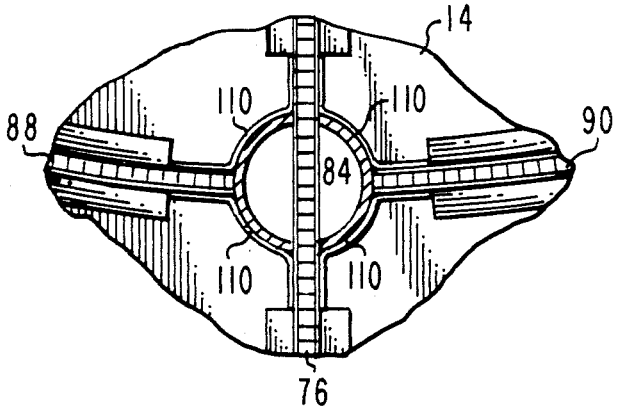
FIG. 7 is a portion of the embodiment of FIG. 5 taken along lines 7—7.

As shown in FIG. 6 there are also multi-ply corner doublers such as 117 and 118 perpendicular to reflectors 12 and 14 which join the abutting ends of the various ribs to other ribs, e.g., the ends of ribs 54, 56, 58, and 60 to the facing surfaces of ribs 40, 44. The doublers 117 and 118 may be multi-ply Kevlar epoxy-reinforced fabric.

As thus described, the rib structure 16 between the reflectors 14 and 12 comprises all radiation transparent materials such as Kevlar fabrics. These fabrics are all bonded with RF transparent adhesives as known in the art. The centralmost portion of the reflectors is devoid of any rib structures between the two reflectors 12 and 14 as shown in FIG. 4. This is important because the rib structure is between the reflecting grid elements of lower reflector 14 and its corresponding feed horn positioned at the focus $f_L$, FIG. 2. The RF transparency of the rib structure 16 is important for minimizing its effects on the beams passing through the structure aimed at and reflected from the grid elements of the lower reflector 14. The sandwich support structure for the grid layer 32, FIG. 1, of upper reflector 12 is RF transparent. Thus, all of the structural elements between the grid layer 32 of the lower reflector 14 and its corresponding feed horn located at point $f_L$, FIG. 2, are essentially RF transparent and therefore have minimum effect on such a beam.

Thermal distortions are minimized in the presence of temperature excursions by combining the structural elements in the relative orientations as described above, FIGS. 1–11. Minimum effects on the combined structure due to moisture are also achieved by the orientations described. Insertion loss is minimized by minimizing the number of support structure elements (ribs) between the reflectors 12 and 14, employing low loss materials, and employing the described orientations of materials and elements for the reflectors 12 and 14 and the rib structure 16.

The legs 80, 82, 84, and 86 may comprise graphite fabric which is RF opaque, however, this material is on the rear side of the reflector 14 out of the way of the beams to be operated on by the reflector 14. The RF opaqueness of the legs is of no consequence to the electrical characteristics to the antenna. The additional rib structure formed by the support structure 18 on the rear centralmost part of the antenna, also because they are located on the rear side of the lower reflector 14, have no detrimental effects on the beams reflected by the upper or lower reflectors. A minimum number of structural elements is employed providing a relatively lightweight antenna construction. The advantage of the construction described is a relatively high stiffness and natural frequency, that is, greater than 100 Hz, comfortably separated from most spacecraft system frequencies thus eliminating resonances. Low thermal distortions in an orbital environment are less than 20 mils RMS across the entire structure diameter and less than 60 mils peak at the worst case temperature excursions to be expected in the orbital environment. Relatively low distortions are present due to desorption of moisture absorbed at ground conditions, for example, less than 15 mil RMS and 45 mil peak RMS.

This structure has relatively low weight, less than 14 pounds for a 60" diameter circular aperture dual reflector assembly. While the circular ribs 44 and 46 are relatively more difficult to fabricate since they lie in parallel planes (their edges face in the general aperture direction), other rib structures comprising straight elements rather than circular elements to form a polygon type of rib structure may be employed in the alternative. These other structures weigh slightly more than the structure described above and may also include more rib elements in the critical center aperture area between the upper and lower reflectors. While four legs are shown, it is apparent that fewer or greater number of legs may also be employed.

An example of possible materials which may be employed for this antenna construction include Fiberite Kevlar fabric style 120/ epoxy 934 for the face sheets, end closures, clips, and related materials. The honeycomb core may be fabricated of Kevlar 49 material made by the Hexel Corporation designated HRH-49-$\frac{1}{4}$-2.1. Adhesives for bonding the various elements known as EA934, EA956, and EA9312 by the Hysol Company may be employed for bonding the various elements.

It is important that the materials used in the construction of the upper reflector and its supporting structure exhibit low loss tangents and low dielectric constants since some beams pass through this structure to the lower reflector. The described materials achieve this result. The coefficient of thermal expansion for the sandwich structure of each reflector is higher parallel to the core ribbon direction 22, FIG. 11, than perpendicular to that direction. The use of copper or other metals in the grid elements 33 bonded to the top surface of each reflector introduces a high degree of orthotropy to that reflector. The coefficient of thermal expansion in the length direction of the elements 33 when formed of copper, which is typical for this use, is higher than that normal to the direction of the grid elements. The anisotropy in the sandwich structure of each reflector is thus minimized by orienting the core ribbon directions 22 normal to the direction of the corresponding reflector grid elements. Further, the anisotropy of the coefficient of thermal expansion as well as the mechanical stiffness and strength behaviors of each reflector construction is minimized by the quasi-isotropic design of the [0/45]/H.C./[45/0] relationship of the face skin warp and honeycomb construction. The overall effect is to minimize reflector distortions due to space temperature variations.

What is claimed is:

1. An antenna construction comprising:

first and second electromagnetic wave reflectors spaced one over the other, each reflector comprising an array formed of a plurality of parallel, spaced, elongated electromagnetic wave reflecting elements, the elements of one array extending in a direction normal to the reflector elements of the other array, and an element support structure for supporting the elements of that reflector, each said element support structure comprising a member transparent to electromagnetic waves and having a shape conforming to that of its array of reflecting elements;

radiation transparent rib means secured to and between said support structures to form a sandwich construction with said support structures, whereby when a wave is applied through the first reflector to the second reflector, the linearly polarized component thereof reflected from the array of reflecting elements of said second reflector passes through the space occupied by the rib means, the element support structure of the first reflector, and the array of reflecting elements of the first reflector; and said element support structures each have an annular peripheral edge, the edge of one structure being located over the edge of the other structure, said rib means including a first, outer annular rib joined to said two support structures at the region of the peripheral edges of the respective structures, and a second annular rib within and concenctric with said first annular rib and also joined to said two support structures, and a plurality of radially extending ribs between said first and second ribs also joined to said two support structures.

2. An antenna construction comprising:

first and second electromagnetic wave reflectors spaced one over the other, each reflector comprising an array formed of a plurality of parallel, spaced, elongated electromagnetic wave reflecting elements, the elements of one array extending in a direction normal to the reflector elements of the other array, and an element support structure for supporting the elements of that reflector, each said element support structure comprising a member transparent to electromagnetic waves and having a shape conforming to that of its array of reflecting elements;

radiation transparent rib means secured to and between said support structures to form a sandwich construction with said support structures, whereby when a wave is applied through the first reflector to the second reflector, the linearly polarized component thereof reflected from the array of reflecting elements of said said reflector passes through the space occupied by the rib means, the element support structure of the first reflector, and the array of reflecting elements of the first reflector; and said support structures each comprise a first sheet-like honeycomb core and a skin on opposite faces of said core, said rib means comprising a plurality of rib members, each said member being formed of sheet-like honeycomb core material with a skin on opposite faces of the second core, the core and face skins of said support structures constructed of the same material as said rib members.

3. The construction of claim 2 wherein each core of a support structure comprises ribbons of core material having parallel length dimensions, the skins on each core comprising a woven epoxy reinforced fabric, the warp of said fabric being parallel to the direction of the length dimension of its core ribbons, and said elements being normal to said length direction.

4. The construction of claim 3 wherein said rib means comprises a plurality of annular and radially extending ribs secured to and between said element support structures.

5. The construction of claim 4 wherein said annular ribs comprise a plurality of spaced, concentric ribs, said radial ribs comprising spoke-like ribs extending between said concentric ribs.

6. The structure of claim 5 wherein said reflector support means comprises a plurality of tubular legs attached to and extending away from the convex side of the lower support structure, each leg at the joint of an annular and radial rib.

7. An antenna construction comprising:

first and second electromagnetic wave reflectors spaced one over the other, each reflector comprising an array formed of a plurality of parallel, spaced, elongated electromagnetic wave reflecting elements, the elements of one array extending in a direction normal to the reflector elements of the other array, and an element support structure for supporting the elements of that reflector, each said element support structure comprising a member transparent to electromagnetic waves and having a shape conforming to that of its array of reflecting elements;

radiation transparent rib means secured to and between said support structures to form a sandwich construction with said support structures, whereby when a wave is applied through the first reflector to the second reflector, the linearly polarized component thereof reflected from the array of reflecting elements of said second reflector passes through the space occupied by the rib means, the element support structure of the first reflector, and the array of reflecting elements of the first reflector, said support structure and rib means each being constructed of opexy-reinforced woven polyparabenzamide fabric;

each said support structure comprises a honeycomb sheet-like core and a skin on opposite faces of said core, said face skins each comprising a inner and outer ply of said fabric, the warp of each outer ply being normal to the length dimension of the corresponding reflecting elements on that structure and the warp of each inner ply being at about 45° to the warp of the outer ply.

8. The construction of claim 7 wherein said rib means comprises a plurality of ribs, each rib comprising a sheet-like honeycomb core and a skin on opposite faces of that core, said face skins each comprising two plies of said fabric, with the warp of one ply being at about 45° with respect to the warp of the other ply.

9. An antenna construction comprising:

first and second parabolic electromagnetic wave reflectors, said reflectors being spaced from one another with the concave front surface of the second reflector facing the convex rear surface of the first reflector, each said reflector including an array of parallel wave reflecting elements, the elements of one reflector being oriented normal to the elements of the other reflector, and each reflector including a support transparent to electromagnetic waves of the same shape as the said reflector, each support bonded to the convex rear surface of its respective reflector; and electromagnetic wave transparent rib structures joining the wave reflectors for forming with the reflectors an integral structure, said reflector supports and said rib structures each being constructed of a sheet-like honeycomb core and a skin on opposite faces of the honeycomb core, said face skins each comprising at least one ply of a woven electromagnetic wave transparent fabric.

10. The construction of claim 9 wherein the core and face skins of said rib structures lie in planes substantially parallel to the same direction.

11. The construction of claim 10 wherein said rib structures include at least two annular spaced concentric ribs and a set of radially extending ribs between and joined to said concentric ribs.

12. The construction of claim 9 wherein said reflectors each have a vertex adjacent one edge thereof, said vertexes being in spaced relation to spatially separate the corresponding focal point locations.

* * * * *

UNITED STATES PATENT AND TRADEMARK OFFICE
CERTIFICATE OF CORRECTION

PATENT NO. : 4,575,726

DATED : March 11, 1986

INVENTOR(S) : Raj Natarajan Gounder

It is certified that error appears in the above-identified patent and that said Letters Patent is hereby corrected as shown below:

Column 5, line 67, before "The" insert --$V_U$--.

Column 8, line 67, "concenctric" should be --concentric--.

Column 9, line 22, "said" (second occurrence) should be --second--.

Column 10, line 15, "opexy-reinforced" should be --epoxy-reinforced--.

Column 10, line 18, "a" should be --an--.

Signed and Sealed this

*Seventeenth* Day of *June 1986*

[SEAL]

*Attest:*

DONALD J. QUIGG

*Attesting Officer*

*Commissioner of Patents and Trademarks*